US007111431B2

(12) United States Patent
Stauder-Buschlinger et al.

(10) Patent No.: US 7,111,431 B2
(45) Date of Patent: Sep. 26, 2006

(54) BULLETPROOF OBSERVATION TOWER

(75) Inventors: Bernadette Stauder-Buschlinger, Ruppertsberg (DE); Fred Rötschke, Pirmasens (DE)

(73) Assignee: Theisinger und Probst Bauunternehmung GmbH, Pirmasens (DE)

( * ) Notice: Subject to any disclaimer, the term of this patent is extended or adjusted under 35 U.S.C. 154(b) by 311 days.

(21) Appl. No.: 10/753,547

(22) Filed: Jan. 8, 2004

(65) Prior Publication Data

US 2004/0148873 A1 Aug. 5, 2004

(30) Foreign Application Priority Data

Jan. 21, 2003 (DE) ..... 203 00 959

(51) Int. Cl.
*E04H 3/08* (2006.01)

(52) U.S. Cl. ..... 52/106

(58) Field of Classification Search ..... 52/106, 52/202, 203; 109/1 S, 49.5, 78
See application file for complete search history.

(56) References Cited

U.S. PATENT DOCUMENTS 1,827,347 A * 10/1931 Barota ..... 109/9
5,747,159 A * 5/1998 Labock ..... 428/335
6,360,494 B1 * 3/2002 Emerson ..... 52/106

* cited by examiner

*Primary Examiner*—Carl Friedman
*Assistant Examiner*—Jessica Laux
(74) *Attorney, Agent, or Firm*—Collard & Roe, P.C.

(57) ABSTRACT

A watch or observation building having an observation section comprising a plurality of bullet proof panes having at least two side faces for observing surroundings. Each of these plurality of bullet proof panes lie next to one another with each face of the bullet proof panes meeting an adjacent face of an adjacent pane on a substantially vertical axis and press against each other along a horizontal direction. Each of the plurality of bullet proof panes face an observation direction such that a line perpendicular to a surface of each of said plurality of panes extends towards the different observation directions.

1 Claim, 2 Drawing Sheets

BULLETPROOF OBSERVATION TOWER

BACKGROUND

The present invention relates to a watch and/or observation tower having a plurality of panes for observing different surroundings.

It is known to equip watch and/or observation buildings with bullet-proof panes. It is then possible to observe the surroundings or a certain viewing area from the observation position of a person on watch within the watch and/or observation building.

The present invention is based on the task of improving the possibility of observing surroundings.

SUMMARY OF THE INVENTION

This task is accomplished according to the invention, wherein the viewing area is subdivided into different observation directions that lie next to one another in a horizontal direction. Each observation direction has a pane assigned to it. The line that is perpendicular to the surface of these panes lies essentially in the observation direction.

In this way, the watch personnel can look in the individual observation directions at a pane in an almost perpendicular direction. This design allows for a good view through a pane. In the case of bullet-proof glass, the more the angle of view is slanted, the more the view through the glass is reduced. As compared with other known solutions in which a single pane is located in a perpendicular direction only in front of the corresponding person, this person looks at the glass at a comparative slant if the person turns to look in the direction of one of the sides, to cover the edge of the field of vision. The view through such a pane is then correspondingly poor. By dividing the observation section into individual segments or different panels, the invention creates a good view through the bullet-proof glass even at the edge regions of the field of view.

The panes are affixed abutting one another along their vertical lines.

This results in an almost closed field of view through the directly adjacent viewing directions, because the individual viewing directions are brought together.

In the structure, the watch and/or observation building has a basic shape that is at least essentially elliptical, whereby the panes are arranged along this basic shape.

In this way, architectural concerns can also be taken into account. It has been shown that with such an arrangement, a street that extends in a straight line can be observed over a wide area, if the longitudinal direction of the street extends parallel to the longer semi-axis of the ellipses.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
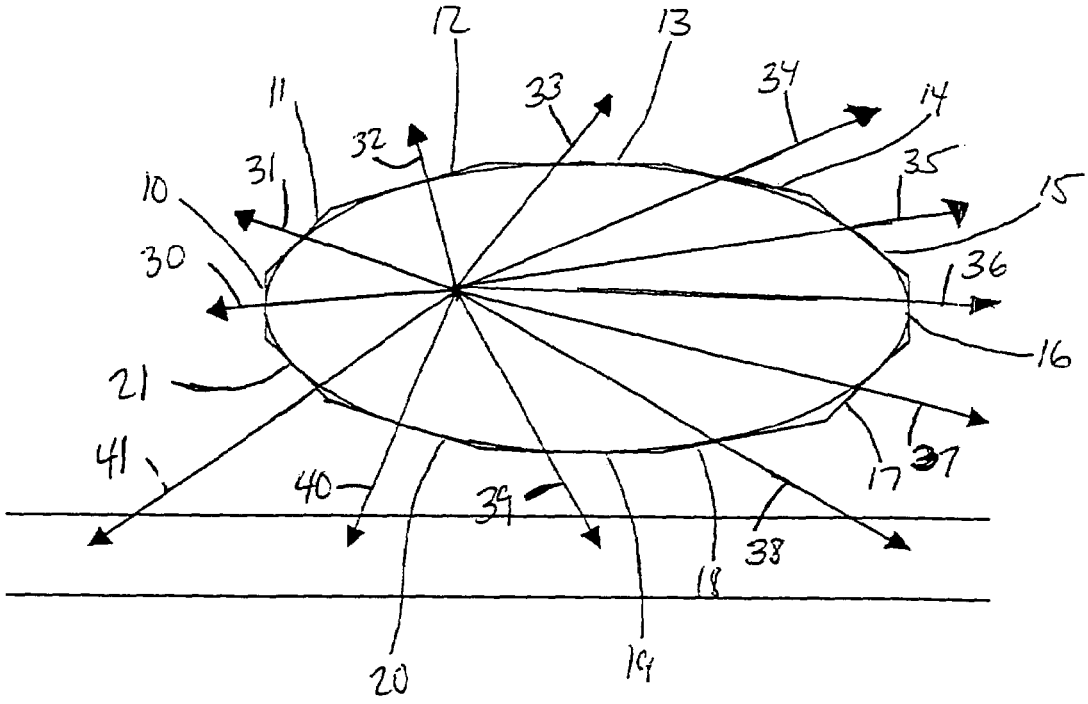
FIG. 1 shows a top sectional view of the device wherein this device is formed as a broken ellipsis.

Referring in detail to the drawings, FIG. 1 shows a top view of an observation section wherein this observation section shows a plurality of different panes 10, 11, 12, 13, 14, 15, 16, 17, 18, 19, 20 and 21 extending out in a plurality of different observation directions 30, 31, 32, 33, 34, 35, 36, 37, 38, 39, 40 and 41.

With this view, FIG. 1 shows a top view of the different panes in an observation section in an observation building.

Because of the basic elliptical shape, there should be a relatively wide pane directly in front of the person on watch, to observe the area directly in front of the watch and/or observation building, without any interruption being caused by the abutment of two panes. The field of view is supposed to extend over the entire width. The field of view is subdivided into horizontally adjacent observation directions 30, 31, 32, 33, 34, 35, 36, 37, 38, 39, 40 and 41. With a corresponding change of the observation direction, the increasingly smaller panes 13, 14, and 15 along the circumference of the ellipse result in a corresponding change of the perpendicular direction 33, 34 and 35, onto the individual panes 12, 13, 14, and 15. This structure allows users to observe areas that lie farther away. The width of the panes can also be selected to be different from that shown in this exemplary embodiment. For example, it is possible to select the width of the panes to be smaller and therefore to provide a larger number of panes.

Each of the panes join each other along a substantially vertical axis and can be made to press against each other in a substantially horizontal direction. The connection of each of the panes creates an angle that supports the elliptical shape.

Figure 2:
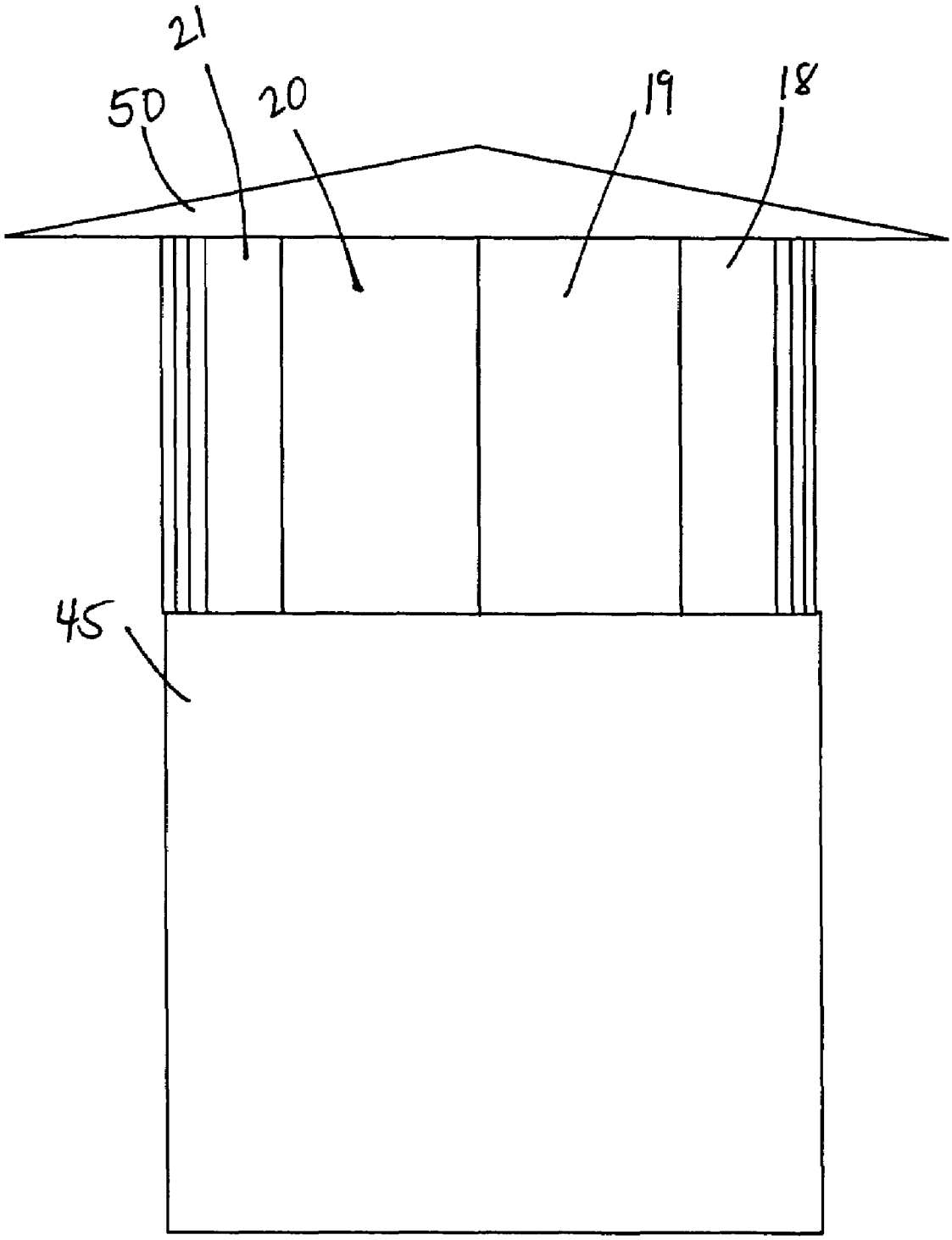
FIG. 2 shows a side view of the device shown in FIG. 1.

FIG. 2 shows an example of a use of the panes in building that can have a masonry base 45 onto which the panes 10, 11, 12, 13, 14, 15, 16, 17, 18, 19, 20 and 21 are set (See FIG. 1). Furthermore, it is advantageous if the watch and/or observation building also has a roof 50.

Accordingly, while at least one embodiment of the present invention has been shown and described, it is to be understood that many changes and modifications may be made thereunto without departing from the spirit and scope of the invention as defined in the appended claims.

What is claimed is:

1. A watch or observation building having an observation section comprising:

a plurality of bullet proof panes for observing surroundings and having at least two side faces for observing surroundings wherein each of said plurality of bullet proof panes lie next to one another with each side face of said bullet proof panes meeting an adjacent side face of an adjacent pane on a substantially vertical axis but wherein each of said plurality of bullet proof panes face an observation direction such that a line perpendicular to a surface of each of said plurality of panes extends towards said observation direction, wherein said plurality of bullet proof panes are joined together in elliptical form to form a substantially elliptically shaped observation section; and wherein at least one of said plurality of bullet proof panes is larger than a horizontally adjacent one of said plurality of bullet proof panes.

* * * * *